US005758752A

United States Patent [19]

King et al.

[11] Patent Number: 5,758,752

[45] Date of Patent: Jun. 2, 1998

[54] AUTOMATICALLY EXTENDABLE AND RETRACTABLE WHEEL ASSEMBLY FOR LUGGAGE

[75] Inventors: William L. King; David Crumrine, both of Denver, Colo.

[73] Assignee: Samsonite Corporation, Denver, Colo.

[21] Appl. No.: 813,481

[22] Filed: Mar. 7, 1997

[51] Int. Cl.[6] ..... A45C 5/14; A45C 13/26

[52] U.S. Cl. ..... 190/18 A; 190/39; 190/115; 16/19; 16/34; 280/37

[58] Field of Search ..... 280/37; 190/18 R, 190/18 A; 16/19, 34

[56] References Cited

U.S. PATENT DOCUMENTS

| | | | |
|---|---|---|---|
| Re. 29,036 | 11/1976 | Hager . | |
| 1,081,670 | 12/1913 | James . | |
| 1,099,933 | 6/1914 | Pohrer . | |
| 1,176,876 | 3/1916 | Variabedian . | |
| 2,417,553 | 3/1947 | Jensen . | |
| 2,421,123 | 5/1947 | Jensen . | |
| 2,439,660 | 4/1948 | Keil | 190/18 A X |
| 2,628,108 | 2/1953 | Rutledge . | |
| 2,654,493 | 10/1953 | Kernkamp . | |
| 2,774,986 | 12/1956 | Moorehouse | 16/34 |
| 3,178,197 | 4/1965 | Boatner . | |
| 3,655,212 | 4/1972 | Krass . | |
| 3,724,617 | 4/1973 | Lawler . | |
| 3,873,118 | 3/1975 | Takagi . | |
| 3,891,230 | 6/1975 | Mayer | 190/18 A X |
| 4,026,569 | 5/1977 | Staal | 190/18 A X |
| 4,097,955 | 7/1978 | Foge et al. | 190/18 A X |
| 4,311,222 | 1/1982 | Castanier | 190/18 A |
| 4,397,062 | 8/1983 | Huang | 190/18 A X |
| 4,524,482 | 6/1985 | Mueller | 190/18 A X |
| 4,588,055 | 5/1986 | Chen . | |
| 4,773,123 | 9/1988 | Yu . | |
| 5,044,476 | 9/1991 | Seynhaeve . | |
| 5,154,265 | 10/1992 | Capistrant . | |
| 5,167,389 | 12/1992 | Reimers . | |
| 5,375,685 | 12/1994 | Plath | 190/18 A |

FOREIGN PATENT DOCUMENTS

| | | | |
|---|---|---|---|
| 1024109 | 1/1978 | Canada | 190/18 A |
| 0 187 183 | 1/1985 | European Pat. Off. . | |
| U9302636 | 10/1993 | European Pat. Off. . | |
| 961977 | 5/1950 | France . | |
| 968949 | 5/1954 | France . | |
| 1145985 | 11/1957 | France . | |
| 1155439 | 4/1958 | France . | |
| 1455429 | 10/1966 | France . | |
| 481221 | 8/1929 | Germany . | |
| 726446 | 10/1942 | Germany | 190/18 A |
| 839689 | 5/1952 | Germany . | |
| 2359229 | 6/1975 | Germany . | |
| 550044 | 10/1956 | Italy . | |
| 1581310 | 12/1980 | United Kingdom | 190/18 A |
| 9219463 | 11/1992 | WIPO | 16/19 |

OTHER PUBLICATIONS

Article/Advertizement, Remin "Kart–A–Bag" Cart, Showcase Magazine, Feb./Mar. 1995, vol. 20, No. 1, p. 50.

*Primary Examiner*—Sue A. Weaver

*Attorney, Agent, or Firm*—Rod D. Baker; Gregory W. O'Connor

[57] ABSTRACT

Automatically retractable and extendable wheel assembly is disclosed for use in conjunction with luggage cases, especially upright carry-on luggage cases and garment bags. Luggage wheels automatically extend to provide a luggage case which is tilted and with a long wheel base so that the case may comfortably and with stability be pushed or pulled across the floor upon three or more wheels, thereby removing the weight of the case from the user's arm. When the case is removed from the floor, the luggage wheels automatically retract to a protected position, thereby reducing the overall dimensions of the case to permit it to be carried aboard aircraft and stored in overhead luggage bins. Apparatus is disclosed for preventing inadvertent retraction of a wheel when the wheel encounters a pebble or crack in the floor.

28 Claims, 5 Drawing Sheets

AUTOMATICALLY EXTENDABLE AND RETRACTABLE WHEEL ASSEMBLY FOR LUGGAGE

BACKGROUND OF THE INVENTION

1. Field of the Invention

The invention relates to automatically extendable and retractable wheel assemblies, particularly wheel assemblies for use on luggage.

2. Background of the Invention

As early as the late nineteenth century, patent literature showed large wooden trunks with small metal wheels built into wood strips or skids. Conventional suitcases having either two or four wheels have been standard in the industry for years. Wheels are popular on horizontal cases, known as "pullman" cases, and upon "vertical" cases adapted to be rolled across a supporting surface with the major dimension of the case disposed at an angle to the supporting surface.

A pullman case has wheels attached to the bottom wall of the case, and the case is towed on these wheels by a strap or handle attached on an end wall near an upper corner of the case. A conventional wheeled pullman has two fixed-axis wheels spaced from one another along the relatively narrow width dimension of the case to support the back end of the case. A pair of caster type wheels support the front end of the case. The user pulls the case around on these four wheels as if it were a rather narrow, tall wagon.

Recently, pullman cases have declined dramatically in popularity with luggage users. One of the reasons for the declining popularity of wheeled pullman cases is their relative instability while being wheeled. Pullman cases manifest a tendency to fishtail or tip while being towed, and are perceived generally to be difficult to steer.

Another style of wheeled case is the immensely popular vertical, or "upright," luggage case. A typical upright case has a pair of fixed axis wheels spaced along a long edge defined by the intersection of the back and the bottom of the case. These wheels are oriented so that the case is rolled broadside. The upper face of the case has a handle with which the user balances the case on these two wheels.

Known upright wheeled luggage cases often manifest either one, or both, of two problems: user discomfort and instability. Most commonly encountered wheeled uprights must be tipped from a vertical position and towed on two wheels—requiring constant support from the user in order to remain upright—posing the problem of strain and discomfort in the user's arm. A conventional upright luggage has a pull handle which typically is retractable/extendable and configured to be gripped in one hand and used to tow the luggage. The two wheels normally are mounted on an edge of the bottom of the case, and the case is tipped toward the user to be positioned for towing.

The user must then constantly support and steady the case in the tilted wheeling position, with a significant portion of the weight of the case borne by the user's rearwardly outstretched arm.

A possible solution to user discomfort is the provision of additional wheels upon the bottom of the upright case, whereby the case may stand in a balanced upright position upon three or more wheels with no weight borne by the user's arm. However, for such a case to be satisfactorily stable when pushed or pulled, it must satisfy minimum requirements for wheel base length, that is, the distance between the front wheels and the back wheels, measured between respective axles and generally parallel to the direction of travel. One such luggage case is described in U.S. patent application Ser. No. 08/636,595, assigned to the assignee of the present application, the teachings of which are hereby incorporated by reference. Too short a wheel base results in an upright case that readily tips over in the direction it is pushed or pulled.

Luggage users for a variety of reasons increasingly demand "carry on" luggage, i.e., luggage sized to be carried into the passenger sections of aircraft, buses, and other common carriers. Carry on luggage must be easily carried, but also must satisfy certain restrictive exterior dimensional criteria imposed by airlines so to be small enough to fit in overhead or under-seat storage compartments.

A problem encountered in the field of wheeled luggage is the need to provide an upright case that is small enough to be carried on, has more than two wheels to remove the wheeled load from the user's arm, and yet offers an adequate wheel base to be stable when pushed or pulled. A desirable carry on upright case has an aesthetically pleasing appearance. But more importantly, a need remains for a case adapted to be small enough to fit into overhead aircraft storage bins, which supports the weight of the case and its contents when wheeled across the floor, and yet has an adequate wheel base to be stable while pushed or pulled. Against this background, the present invention was developed.

SUMMARY OF THE INVENTION

The invention relates to a wheel assembly specially adaptable for use on a wheeled luggage item such as a suitcase, garment bag, or the like. The invention includes a wheel assembly that is automatically extendable and retractable from the body of the luggage. The wheel component of the assembly automatically pivots into an extended, use position when the item of luggage is positioned for wheeling—either pushing or pulling—across a supporting surface. The wheel component of the assembly automatically retracts into a storage position when the item of luggage is lifted from the floor or other supporting surface, and/or oriented for stowage in an automobile trunk or aircraft overhead storage bin. When the wheel assembly is extended, the body of the item of luggage is tipped somewhat from a vertical orientation, and the wheelbase of the luggage is lengthened, to optimize the rolling stability of the case. When the wheel assembly is in the retracted position, the wheel component is withdrawn to a less obtrusive position, reducing the overall exterior dimensions of the case and protecting the wheel component while not in use.

An object of the invention is to provide an automatically extendable and retractable wheel assembly suitable for use upon items of luggage.

Another object of the invention is to provide an article of luggage that may be carried aboard aircraft, and yet also may be stably wheeled across a supporting surface with no weight upon the user's arm.

An advantage of the invention is the provision of an article of luggage with wheels which automatically retract so that the luggage is sufficiently small to be carried on board commercial aircraft and which automatically extend so that the luggage may be wheeled upon at least three wheels across a supporting surface.

According to the present invention, there thus is provided an automatically retractable and extendible wheel assembly for use in combination with a luggage case to roll the case across a supporting surface, the luggage case comprising a body in which clothing and personal items may be stored, the body having a bottom, a first wheel upon the bottom, and a back intersecting the bottom to extend upwardly therefrom, and the wheel assembly comprising at least one hollow housing fixed on the body substantially at the intersection of the bottom with the back; an arm member having a proximate end and a distal end; axle means for pivotally mounting the proximate end of the arm member within the housing for rotation of the arm member and the housing with respect to each other, the arm member pivotal between a retracted position and an extended position with respect to the back; a stop member upon the housing contactable with the arm member when the arm member is in the extended position; means for biasing the arm member toward the retracted position; and at least one other wheel rotatable upon the distal end of the arm member; wherein when the arm member is in the retracted position and the case is placed upon the supporting surface with the first wheel and the other wheel in contact with the supporting surface, the weight of the case causes the arm member and the housing to rotate in opposite directions about the axle, and the first wheel and the other wheel to roll on the supporting surface in substantially opposite directions until the arm member attains the extended position, whereby to lower the axle toward the supporting surface to shift the body from a first position to a second position with respect to the supporting surface, and further wherein when the case is lifted from the supporting surface the means for biasing returns the arm member to the retracted position.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DESCRIPTION OF PREFERRED EMBODIMENT(S)

Figure 1:
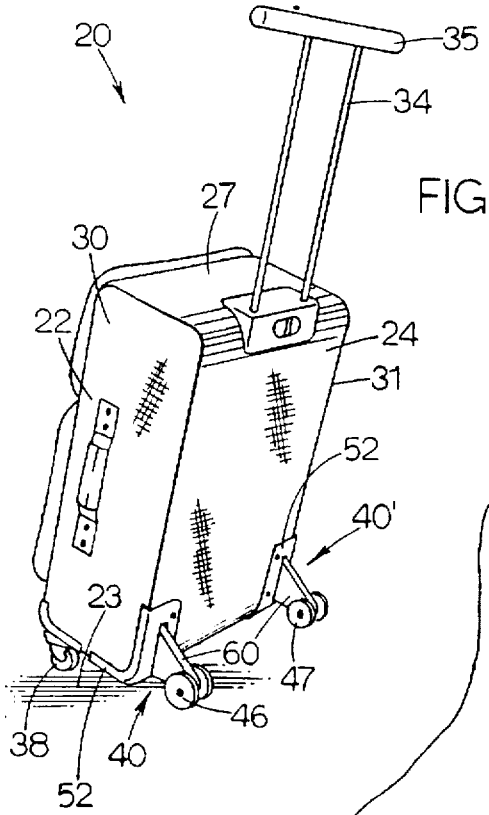
FIG. 1 is a rear perspective view of a luggage case including a preferred embodiment of the present invention.
Figure 5:
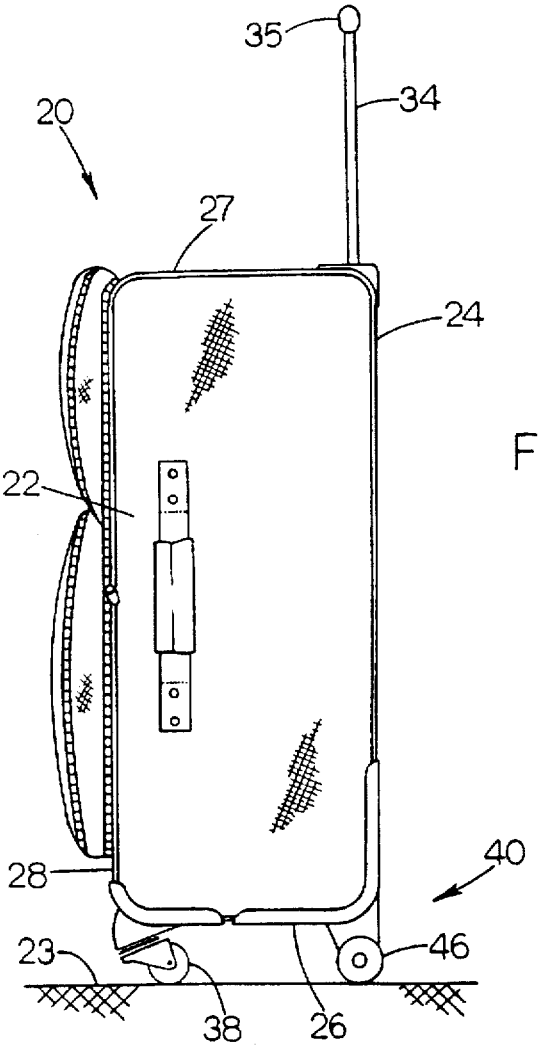
FIG. 5 is a right side view of a luggage case including a preferred embodiment of the present invention, the luggage case being in a first position with the wheel assembly in a retracted position.
Figure 6:
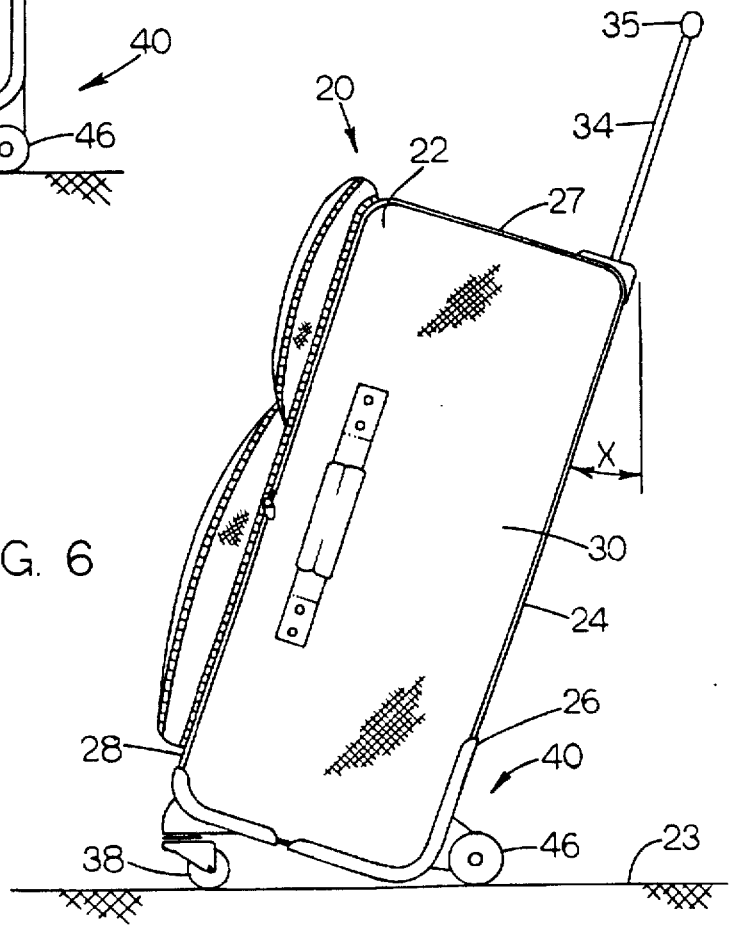
FIG. 6 is a right side view of a luggage case including a preferred embodiment of the present invention, the luggage case being in a second position with the wheel assembly in an extended position.

Referring to the figures, in which like numerals designate corresponding elements throughout the figures, there is seen in FIGS. 1, 5 and 6 an article of luggage 20 according to the present invention. The article of luggage 20 preferably comprises an "upright" or "vertical" luggage case, e.g., the longest dimension of the body 22 of the case 20 is disposed at a large angle, in excess of 450°, with respect to the supporting surface 23, so that the case 20 is adapted to be wheeled broadside and uprightly, the orientation common for vertical cases recently in the art. Throughout this disclosure, the supporting surface 23 is assumed to be generally horizontal, although it is understood that the supporting surface may be inclined, such as in the case of a ramp, without affecting the scope of the invention. It also will be immediately appreciated that the present invention finds beneficial application with other types of wheeled luggage, for instance, wheeled garment bags.

As shown in FIGS. 1, 5, and 6, the body 22 of the case 20 preferably is generally parallelepiped in shape, the body 22 having a back 24 which preferably but not necessarily is parallel to a front 28. The back 24 intersects and extends upward from a bottom 26. A top 27, and two sides 30, 31 complete the enclosed body 22 in which clothing, toiletries, personal effects and the like may be stored for transportation.

The body 22 may be provided with a full complement of exterior and interior pockets, carry handles, decorative piping, and the like. More specifically, the body 22 is provided with a wheel handle 34, extendable from and retractable into the body 22 substantially adjacent to the back 24, for selectively pushing and pulling the article of luggage 20 across the supporting surface 23. As illustrated, the wheel handle 34 preferably extends from the top 27 of the body 22 substantially adjacent to the intersection of the top 27 with the back 24, and is collapsible into the interior of the body 22 when not in use. A user may grasp the handle grip 35 of the wheel handle 34 in the extended position, and thereby pull the case 20 behind him, or push the case in front of him.

To permit the easy rolling of the case 20 across the supporting surface 23, the body 22 is provided with at least one, but preferably two, front wheels 38 (only one of two front wheels shown in the figures). Front wheels 38 are securely mounted on the bottom 26 of the body 22, in a forward position substantially proximate to the edge of the body defined by the intersection of the front 28 with the bottom 26, generally according to convention. The front wheels 38 preferably comprise caster type wheels which rotate about their respective vertical axes, known in the art for easing the steering of the case 20.

Continuing reference to FIGS. 1, 5 and 6 indicates that the body 22 is further provided with at least one but very preferably two rear wheel assemblies 40, 40' according to the present invention. The two wheel assemblies 40, 40' are substantially identical in form and function, so that further description of one assembly 40 adequately describes all other like assemblies.

The wheel assemblies 40, 40' are a central feature of the present invention. Wheel assemblies 40, 40' permit the automatic adjustment of the positions of the rear wheels 46, 47 in relation to the body 22 of the case 20, whereby the case 20 may be sufficiently compact to be carried on an airplane, and yet also provide for a stable, four-wheeled motion across the supporting surface 23 of an airport terminal, parking lot, residential driveway, or the like. In the preferred embodiment, and as indicated by FIGS. 1, 5, and 6, each of assemblies 40, 40' is disposed within the body 22 at or near the intersection of the back 24 and the bottom 26. As best seen in FIG. 1, each of the wheel assemblies 40, 40' also preferably is mounted in the body 22 near a respective one of the sides 30, 31 of the body 22, effectively to maximize the distance between the rear wheels 46, 47.

Attention is invited to FIG. 5, which shows the wheel assembly 40 in the retracted position and the body 22 in a substantially perpendicular, approximately truly vertical, position with respect to the supporting surface 23. In this position, the rear wheel 46 is disposed beneath the body 22 of the case 20, between the body 22 and the supporting surface 23. Notably, the rear wheel 46 is also inside the plane of the back 24 of the case, that is, the wheel 46 is inboard of the back 24, between the imaginary plane containing the back 24 and the plane of the front 28 of the body 22. In this position, the body 22 has a relatively compact profile and minimal exterior dimensions, and the wheel 46 is in a comparatively protected and unobtrusive location.

FIGS. 1 and 6 show the wheel assembly 40 in an extended position and the body 22 in a second position having an angular relation with respect to the supporting surface 23. In this position, the rear wheel 46 is in an outboard position, located relatively outwardly from beneath the bottom 26 and outside the plane of the back 24 of the body 22. With the rear wheel 46 outside the back 24, that is, with the imaginary plane containing the back 24 located between the rear wheel 46 and the front 28 of the body 22, the body 22 presents a tilted profile. With the wheel assembly 40 extended, the distance between the front wheel 38 and the back wheel 46 is greater, and the overall front-to-back wheel base of the case 20 is longer, than when the case 20 is in the configuration of FIG. 5. However, the extension of the wheel assembly 40 to the position shown in FIG. 6 increases the effective exterior dimensions of the case 20 when the protruding wheel assembly 40 is considered.

The wheel assembly 40 permits the case 20 to be configured as shown either in FIG. 5 or as in FIG. 6. Moreover, the movement of the rear wheel 46 between the retracted and extended positions is automatic, and occurs in direct response to the physical situation of the case 20. As shall be further explained, the wheel assembly 40 moves to the extended position of FIG. 6 automatically when the case 20 is in position for wheeling, and automatically retracts to the position of FIG. 5 when the case 20 is positioned for stowage, for example in the cabin of an airplane.

A central aspect of the apparatus of the invention is its configuration and orientation with respect to gravity when all the wheels are in contact with the supporting surface 23 and the case 20 is in the second, "tilted" position with respect to the supporting surface, as shown in FIG. 6. For purposes of description, the supporting surface 23 is assumed to be substantially horizontal, but this assumption shall not limit the scope of our invention. In wheeling position, main body 22 is canted toward the user, that is, the top 27 is closer to the user than the bottom 26. Consequently, when the apparatus is pushed across a supporting surface, the body 22 leans away from the direction of travel. The amount of tilt is the size of angle X, shown in FIG. 6. Angle X is the angle included between the main body 22 and a line perpendicular to the supporting surface, measured in a plane parallel to the direction of travel, and thus measures the amount the case 20 tilts from or with respect to the vertical.

We have determined that there is a range of values for angle X which optimize the overall stability of the luggage case 20 while it is being pushed, while preserving an aesthetic appearance. The location of the center of gravity, and the magnitude and direction of the pushing force, influence the rolling stability of the case. The location of the center of gravity, and to a lesser extent the horizontal and vertical components of the pushing force vector, are affected by the size of X. In the invention, angle X preferably is in the range of from about 14° to about 24°. At angles of X in excess of about 24°, the body 22 may express symptoms of static instability, i.e., the body 22 tends to fall backward (in the direction of the tilt) under its own weight, especially when loaded, or may place excessive stress on the wheel assemblies 40, 40' to which the rear wheels 46, 47 are attached. At angles of X less than about 14°, the case 20 is unstable when pushed, tending to overturn. Most preferable, for reasons of stability and aesthetics, is an angle X of about 19°.

Figure 2:
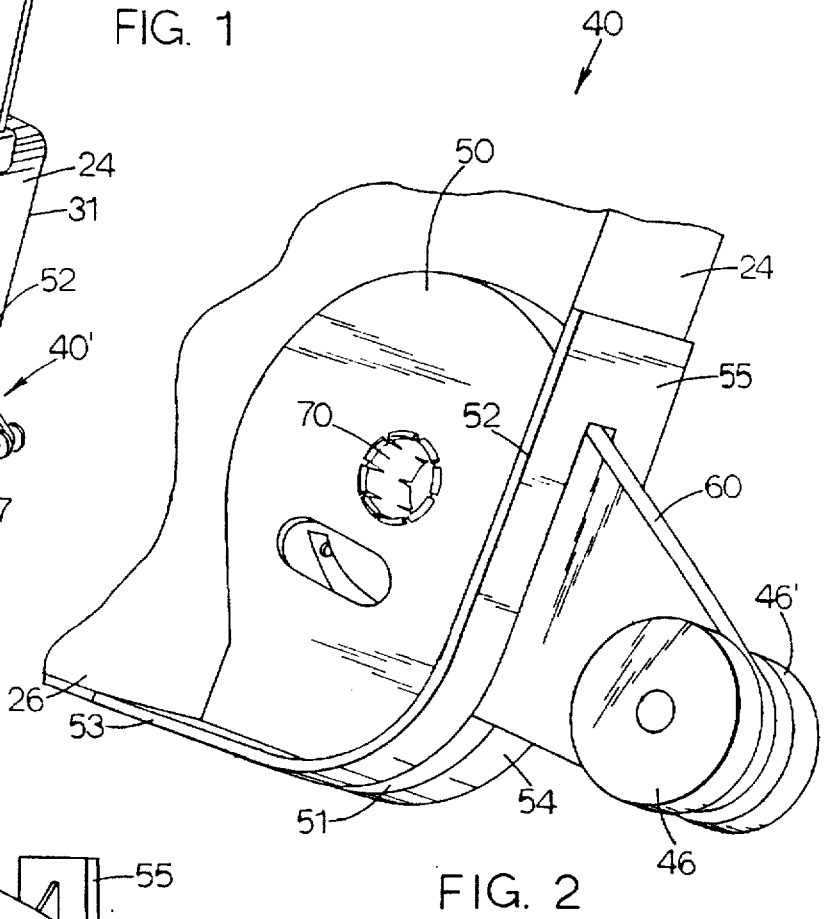
FIG. 2 is an enlarged, perspective, partial sectional view of a portion of FIG. 1, showing a preferred embodiment of the wheel assembly according to the present invention in an extended position.
Figure 3:
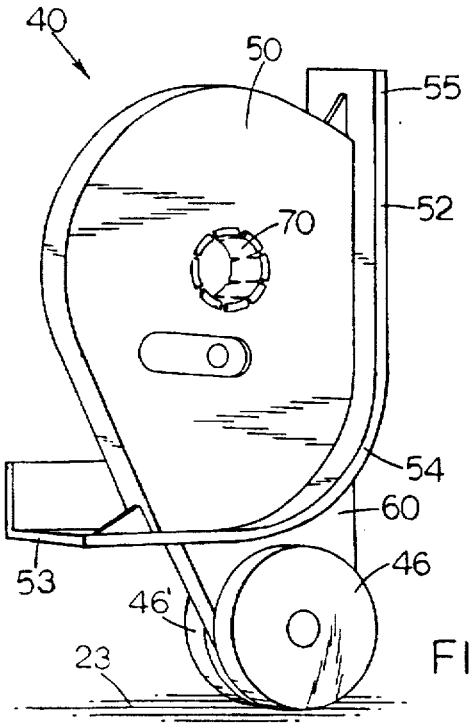
FIG. 3 is a perspective view of the wheel assembly shown in FIG. 2, shown in the retracted position.

Attention is invited to FIGS. 2 and 3, depicting details of the wheel assembly 40. Wheel assembly 40 generally comprises a hollow housing 50 preferably fashioned from rigid, durable thermoplastic. Housing 50 may be assembled from two substantially symmetrical halves secured together in a known manner, and preferably is generally cylindrical. In one preferred embodiment, the generally flat sides of the housing 50, that is, the generally vertical ends of the cylinder shape of the housing, are double-walled for strength. The inside wall (not shown) of the sides also defines the extent of a slotlike pocket within the housing 50 and in which a planar arm member 60 is constrained for rotational, but no translational, movement, as shall be further described. As suggested by the figures, the housing 50 is situated inside the body 22 at or near the edge defined by the junction of the back 24 with the bottom, so that the back 24 and the bottom 26 are both approximately tangential to the generally cylindrical housing 50.

The housing 50 has a rearwardly facing aperture 51 therein. As best seen in FIG. 2, the aperture 51 preferably comprises a narrow, oblong, substantially vertically aligned slot surrounded by a bezel 52. Bezel 52, which is integrally molded with or securely fixed to the housing 50, is shaped to correspond to the contour of the edge defined by the intersection of the bottom 26 with the back 24. A lower portion 53 of the bezel is generally rectilinear and surrounds a lower, straight, segment of the aperture 51. The lower portion 53 of the bezel is adapted to be placed in flush contact with the bottom 26 to provide that the straight lower segment of the aperture 51 defined therein is common to the bottom 26 of the body 22. "Common," in this sense, means that a segment of the aperture 51 penetrates and is approximately coplanar with the bottom 26. Similarly, an upper portion 55 of the bezel 52 is generally rectilinear and surrounds an upper, straight, segment of the aperture 51. The upper portion 55 of the bezel is adapted to be be placed in flush contact with the back 24 of the body to provide that the straight upper segment of the aperture 51 defined therein is common to the back. "Common," in this sense, means that a segment of the aperture 51 penetrates and is approximately coplanar with the back 24. Also as best seen in FIG. 2, the upper and lower straight segments of the aperture 51 are joined by an arcuate intermediate portion defined within an intermediate portion 54 of the bezel 52. Thus, the single continuous aperture 51 in the housing 50 is arcuate along an intermediate section of its length in order to wrap around the bottom back edge of the body 22, and is essentially straight along its terminal segments in order to penetrate portions of both the back 24 and the bottom 26.

An arm member 60 is movably disposed through and within the aperture 51 so that a proximate end of the arm member is within the housing 50 and a distal end of the arm member protrudes outside the housing. In the preferred embodiment, the arm member 60 is substantially planar and aligned within the aperture for sliding movement there along.

Combined reference is made to FIGS. 2, 3, 4A and 4B. The arm member 60 preferably is fashioned from rigid unbreakable thermoplastic, and comprises a planar flange with reinforcing ribs for added strength. The proximate end of the arm member 60 preferably defines a large arcuate portion concentrically disposed within the cylindrical housing 50. The arm member 60 is pivotally mounted within the housing 50 by means of an axle 70, whereby the housing 50 and the arm member 60 may rotate with respect to one another. The axle 70 preferably comprises a slotted cylindrical barrel, both ends of which have a mechanical snap or frictional engagement with opposing sides of the housing 50. An inner circular portion 62 of the arm member 60 is concentrically journalled upon the axle 70 whereby the arm member 60 may pivot upon the axle between the retracted position (FIGS. 3 and 5) and the extended position (FIGS. 1, 2, 4A, and 6).

Figure 4A:
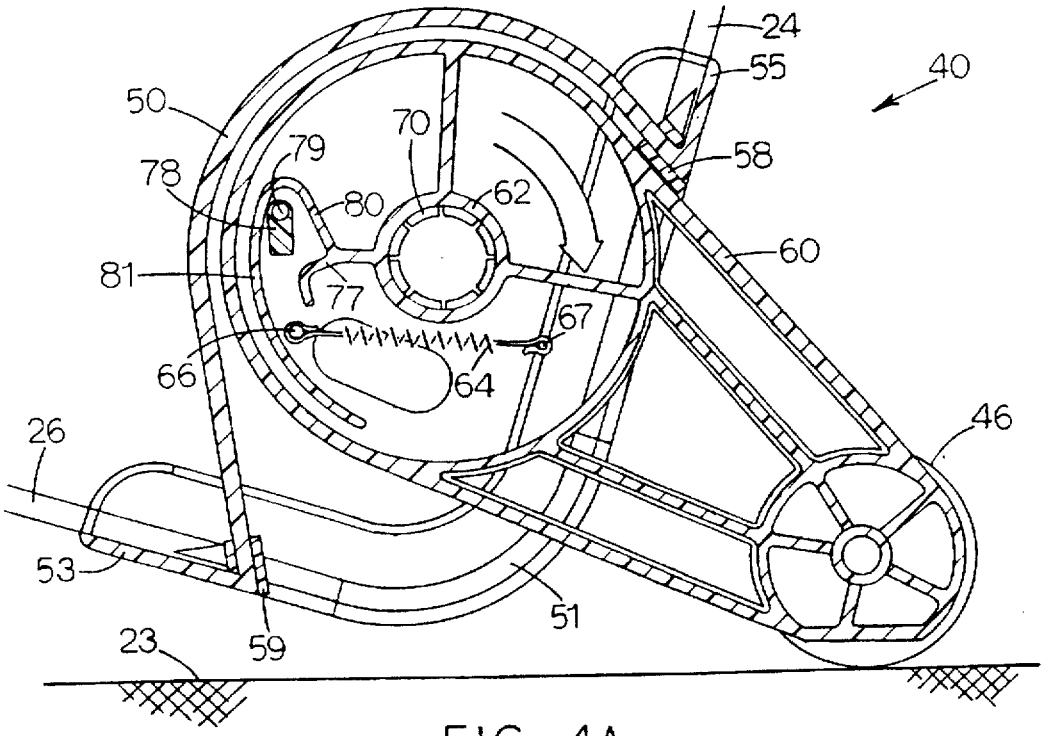
FIG. 4A is a side sectional view of the wheel assembly shown in FIG. 2, depicting the assembly in the free-wheeling, unlocked condition.

FIGS. 2, 3, 4A and 4B illustrate that the extent of the pivotal movement of the arm member with respect to the housing 50 is limited by the contact of the arm member with the upper and lower ends of the slot aperture 51. The respecive portions of the housing 50 defining and delimiting each end of the aperture 51 thus function as stop members, denoted at 58 and 59 in the figures, which check the pivotal movement of the arm member 60 with respect to the housing 50. In the maximally extended position of the arm member 60, the arm contacts the stop member 58 at the top end of the aperture 50, as seen in FIG. 4A. In the maximally retracted position of the arm member 60, the arm contacts the stop member 59 at the opposite, lower, end of the aperture 51, as suggested by FIG. 3. Resilient bumper pads preferably are disposed at the upper and lower respective ends of the slot aperture 51 to provide a cushioned, quiet impact between the stop member portion 58, 59 of the housing 50 and the arm member 60 when the arm member obtains either extreme of the aperture 51. Contact between arm member 60 and either stop member 58 or 59 thus barring the arm member 60 against further pivotal movement in either respective direction.

The slot aperture 51 is sized, and the housing 50 disposed upon the body 22, so 25 that when the arm member 60 is in the maximally extended position, that is when the arm member 60 is in abutting contact with the upper stop member 58, and all the wheels 38, 46, 47 are in contact with the supporting surface 23, the body rests upon the supporting surface 23 to form an angle of approximately 19° therewith. As explained, this angle of tilt of the body 22 provides a case 20 which may be wheeled upon three or four wheels along the supporting surface with comfort and stability.

Reference is made to FIG. 4A. As suggested by the broad directional arrow, the arm member 60 and the housing 50 are free to rotate with respect to one another, subject to the limitation imposed by the length of the slot aperture 51. Nevertheless, the arm member 60 is biased toward the retracted position by the torsional force of a spring 64 connected between the housing 50 and the arm member 60. In one preferred embodiment, the spring 64, comprising an ordinary coil spring, is stretched between a post 66 projecting laterally from an inside wall of the housing 50 and a pin 67 extending laterally from the proximate end of the arm member 60 disposed within the housing 50.

Figure 4B:
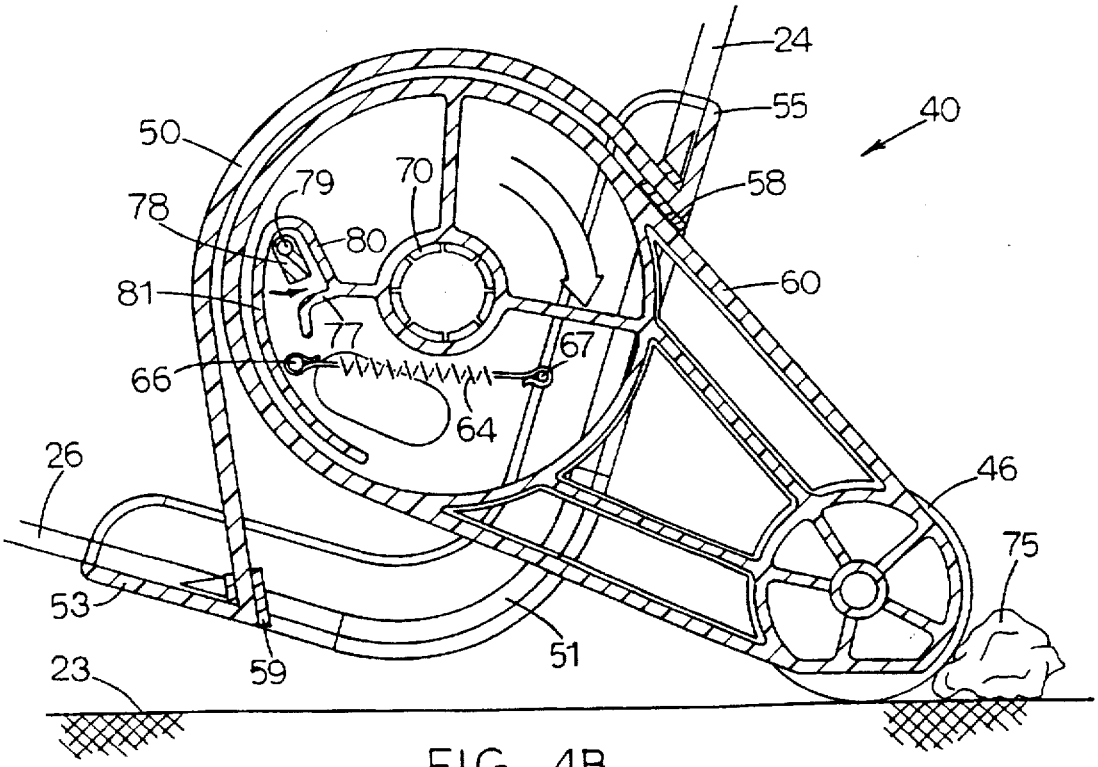
FIG. 4B is a side sectional view of the wheel assembly shown in FIG. 4A, shown in a chocked and locked condition.

The tension in the spring 64 generates a rotary force between the housing 50 and the arm member 60 that biases the arm member in a clockwise direction in FIGS. 4A and 4B, as indicated by the directional arrows in those figures. Accordingly, in the absence of any countervailing force upon the arm member 60, stronger then the spring tension, the spring 64 tends to contract in length to draw the arm member 60 down the slot aperture 51 and against the lower stop member 59 portion of the housing 50, i.e. the arm member 60 when at rest is in the retracted position shown in FIGS. 3 and 5.

Only when a stronger, counterclockwise rotary force is applied to the arm member 60, for instance the reaction force of the supporting surface 23 against the wheel 46 when the case 20 is placed upright upon the supporting surface, does the arm member pivot against the force of the spring 64 and towards the extended position.

At least one wheel 46 is rotatably mounted upon the distal end of the arm member 60; in the preferred embodiment, a pair of wheels 46, 46' are disposed upon opposite sides of the distal end of the arm member 60, and are mounted for rotation upon a shared axle in the arm member 60, as seen in FIGS. 2 and 3. Because the arm member 60 preferably is planar to provide for full freedom of movement of the arm member 60 along the length of the aperture 51, dual wheels 46, 46' on each side of the arm member 60 offer a bilateral symmetry promoting a more stress-resistant assembly 40 than would be provided by a single wheel on a stub axle.

As mentioned, the case 20 is intended for use in either a pushing mode or a pulling mode. In the pushing mode, the user stands behind the case 20, that is, next to the back 24, grasps the grip 35 of the wheel handle 34, and pushes the case in front of him (i.e. from right to left in FIG. 6) with the front wheels 38 leading the tracking of the case. In the pulling mode, the user also stands next to the back 24 and grasps the wheel handle 34, but tows the case behind him as he walks (i.e. from left to right in FIG. 6), with the back wheels 46, 47 leading the tracking of the case 20.

Each of the wheel assemblies 40, 40' is provided with an advantageous latch mechanism to prevent the arm member 60 from pivoting into the retracted position when the wheels 46, 46' encounter a pebble or some other obstruction upon the supporting surface 23 while the case 20 is used in the pulling mode. FIGS. 4A and 4B show that wheel assembly 40 is provided with a stop ledge 77 on the arm member 60, and a pendulum latch 78 hanging from a pin 79 attached to the housing 50. The interaction between the pendulum latch 78 and the stop ledge 77 provides a means for preventing the arm member 60 from suddenly pivoting from the extended position toward the retracted position while the rear wheels 46, 47 are in contact with the supporting surface 23 and while said case is being pulled.

In the preferred embodiment, the pin 79 is integrally molded with and extends horizontally from a side of the housing 50. Accordingly, the pin 79 always maintains a fixed position in relation to the housing 50 and to the body 22 of the case 20. The pendulum latch 78 comprises a rigid, durable, oblong piece of plastic or metal. The latch 78 is rotatably mounted eccentrically upon the pin 79, the pin being connected to or disposed through one end of the pendulum latch 78. The latch 78 rotates about the pin 79, so that in its rest position the latch 78 simply hangs by its own weight in an equilibrium condition substantially vertically below the pin 79, as suggested by FIG. 4A. The pivotal connection between the pin 79 and the pendulum latch 78 is well lubricated, so that any minor force upon the downwardly hanging latch 78 displaces the latch from its rest position and causes it to swing to or fro upon the pin 79.

The stop ledge 77 preferably is molded integrally with and within the interior of the arm member 60. The stop ledge 77 comprises a solid surface which extends substantially radially outward from the axle 70. The stop ledge 77 thus maintains a fixed position in relation to the overall arm member 60, but can rotate with respect to the pendulum latch 78 as the arm member 60 pivots with respect to the housing 50.

FIGS. 4A and 4B also illustrate that when the arm member 60 is in the extended position, the pendulum latch 78 is radially aligned with the stop ledge 77. When the case 20 is being pulled at a generally constant speed across the supporting surface 23 (i.e. from left to right in FIGS. 4A and 4B), the weight of the case pushes the arm member 60 to the extended position, and the arm member 60, stop ledge 77, and pendulum latch 78 are positioned generally as depicted in FIG. 4A. With the case 20 moving at a mostly uniform speed, no significant accelerating forces except gravity act upon the pendulum latch 78, and the latch hangs generally straight down from the pin 79. The pendulum latch 78 is swingable from its equilibrium position to a locking position engaged with the stop ledge 77. Should the wheel 46 unexpectedly encounter an obstruction such as a pebble 75, a crack in the supporting surface, the threshold of a door, or the like as shown in FIG. 4B, the rotation of the wheel 46 abruptly ceases and the rolling motion of the case 20 across the supporting surface is suddenly, perhaps unexpectedly, stopped. When the motion of the case 20 is abruptly stopped, the pendulum latch 78 nevertheless seeks to continue moving in the direction the case 20 was moving, that is, from left to right in FIG. 4B. Consequently, the pendulum latch 78 immediately swings by inertia from its equilibrium position to into the locking positionshown in FIG. 4B. Simultaneously with the stoppage of the case 20, inertial forces rotate the pendulum latch 78 into the locking position, in which position the latch engages against the stop ledge 77 to prevent pivotal movement of the arm member 60 with respect to the housing 50.

The engagement of the pendulum latch 78 with the stop ledge thus acts to prevent most instances of inadvertent wheel retraction. The user confidently may tow the case 20 with the rear wheels 46, 47 leading the way in their extended position. If a wheel encounters an obstruction of sufficient size momentarily to stop the case 20 from rolling, the free end of the pendulum latch 78 swings into proximity with the stop ledge 77; the combined effects of the spring 64 and the wheel 46 pushing against the rock 75 tend to urge the arm member 60 clockwise as shown in FIG. 4B. The end of the pendulum latch 78, however, contacts the stop ledge 77, as shown in FIG. 4B, to prevent any further counterclockwise rotation of the arm member 60. Accordingly, the arm member 60 is barred from sudden, unintended retraction, and the user may simply pull the rear wheel 46 up and over or across any minor obstruction tending to chock the wheel. As soon as the case 20 is freely rolling across the supporting surface 23 once again, the pendulum latch 78 is free to swing under its own weight back to the equilibrium position. With the pendulum latch 78 in the equilibrium position, the arm member 60 is free to automatically pivot clockwise to the retracted position under the force of the torsion spring 64 when the case 20 is lifted from the supporting surface 23.

The interior of the arm member 60 may be provided with guide walls 80, 81 which limit the swinging motion of the pendulum latch 78. Guide walls 80, 81 are fashioned to confine the rotation of the pendulum latch 78 to the arcuate pivotal movement necessary to swing from the disengaged, equilibrium position shown in FIG. 4A to the engaged, locked position depicted in FIG. 4B. Guide wall 80 bars the pendulum latch 78 against uncontrolled 360-degree rotation about the pin 79. Guide walls 80 and 81 also are disposed to prevent the pendulum latch 78 from swinging significantly from the equilibrium position when the arm member 60 is in any position except the extended position. Thus, the pendulum latch 78 is barred from engagement with the stop ledge 77, or from otherwise interfering with the rotation of the arm member 60 with respect to the housing, when the arm member 60 is in any pivotal relation except the substantially extended position shown in FIGS. 4A and 4B.

Figure 7:
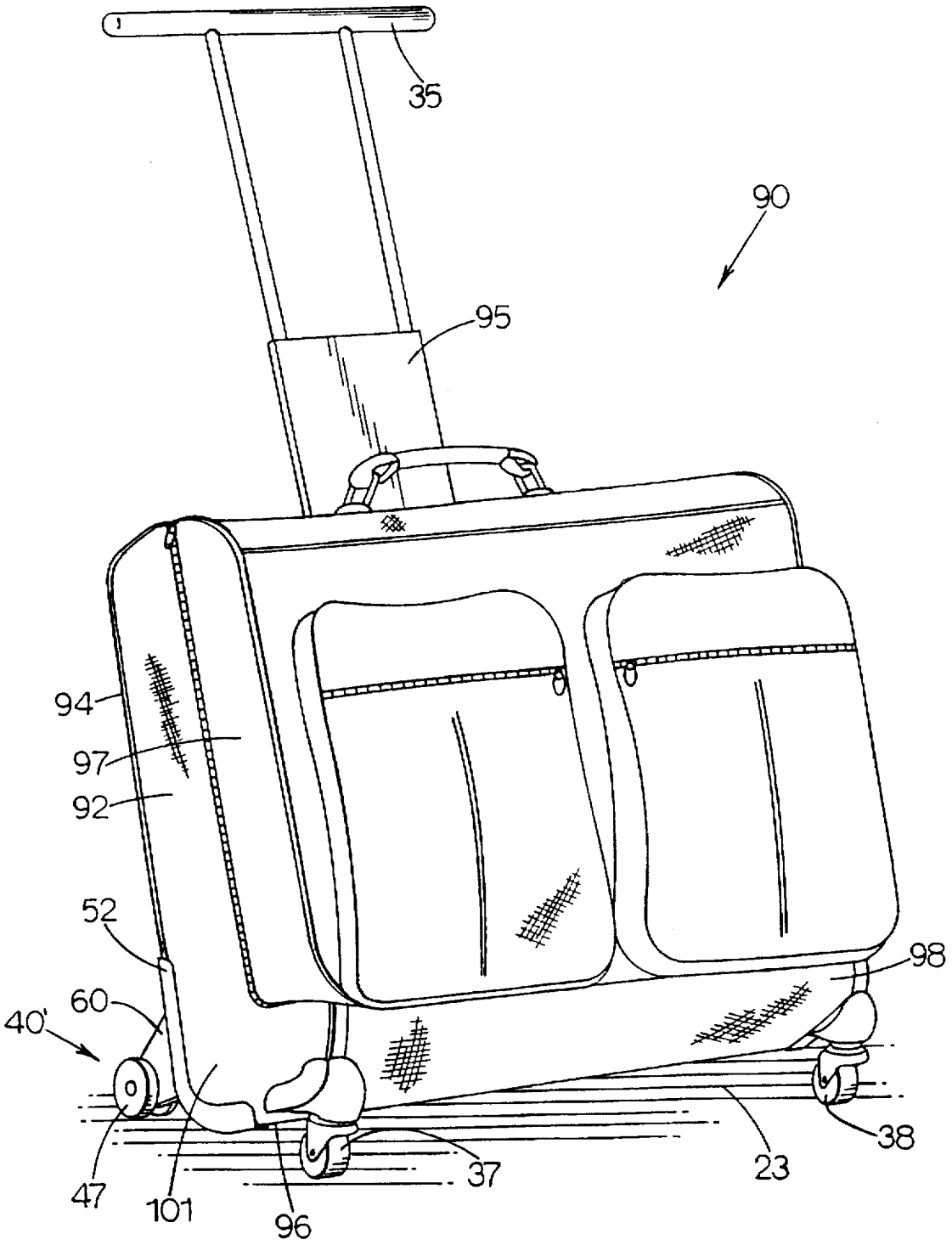
FIG. 7 is a perspective view of a second luggage case including a preferred embodiment of the present invention.
Figure 8:
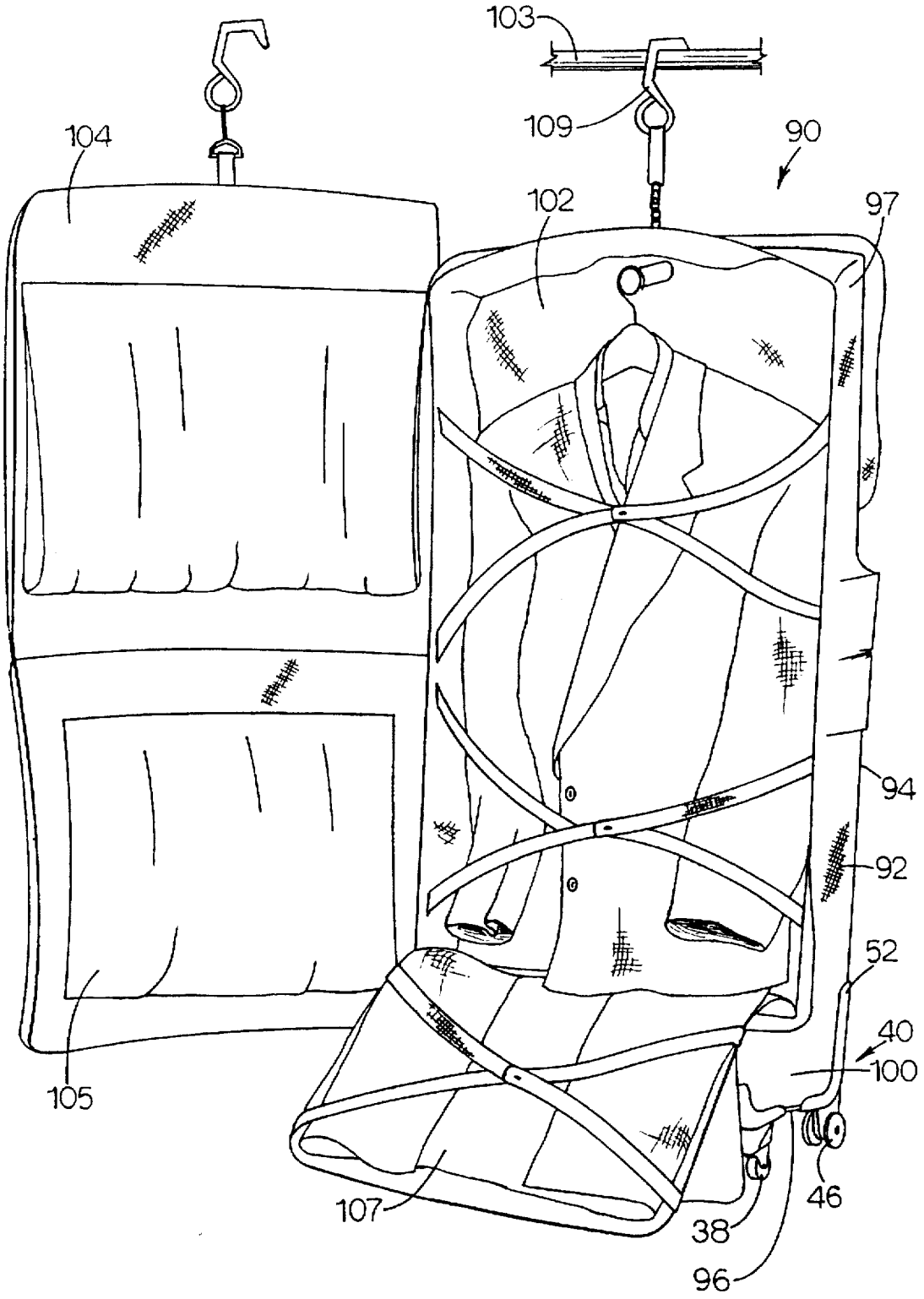
FIG. 8 is a perspective view of the case shown in FIG. 7, shown in an open, hanging, position to reveal the interior.

The invention finds useful application in nearly any type of luggage, particularly vertically oriented cases and carry-on cases. FIGS. 7 and 8 show that the described wheel assemblies 40, 40' may be incorporated into a garment bag 90 alternative embodiment. The garment bag 90, which is adapted to be pushed or pulled "broadside" by the collapsible wheel handle 95, includes a main body 92 which provides structure and form to the bag and includes an upright back 94 extending from a narrow, substantially rigid bottom 96. Front wheels 37, 38, preferably casters, are mounted upon the bottom 96 at the outside corners defined by the intersection of the bottom 96 and the front panel 98 with respective sides 100,101. The inventive wheel assemblies 40, 40' are fixed at the intersection of the back 94 with the bottom 96 substantially as previously described. The bezel 52 wraps around the edge defined by the back 94 and the bottom 96, so that the arm member 60 of each wheel assembly 40, 40' can pivot from the an extended position to a retracted position, as previously described for the parallelepiped case 20.

As best seen in FIG. 7, the bottom 96 and the back 94 of the garment bag 90 are joined in the shape of an "L," the bottom 96 forming the leg of the "L." The bottom 96 and back 94 may be approximately perpendicular, but, as the figures illustrate, when the arm members 60 of the wheel assemblies 40, 40' are extended to place the rear wheels 46, 47 in position for use, the bottom 96 is disposed at an angle with respect to the supporting surface 23 and the back 94 also is tipped to define a complementary angle with respect to the supporting surface. As previously described, when all four wheels 37, 38, 46 and 47 are engaged with the supporting surface and the arm members 60 are in the extended position, the back 94 forms an angle from the vertical of between 14° and 24°, most preferably 19°.

A cover portion 97 encloses the main storage space 102 within the body 92 of the bag 90. Cover portion 97 has a permanent hinged connection, in the form of a fabric living hinge, with the back 94 of the bag, so that the cover portion can be folded medially and down to cover the major portion of the front of the bag 90. The cover portion 97 is releasably connected to corresponding portions of the sides 100, 101 and front panel 98 by means of a sliding fastener such as a zipper. Also, the cover portion 97 may itself enclose a relatively thin, elongated pocket which is releasably closed using a zipper or the like.

The cover portion 97 is detachable from the front panel 98 and sides 100, 101, for pivoting about its connection with the back 94, to obtain the open condition shown in FIG. 8. As shown in FIG. 8, the cover portion 97 itself may be unzipped to swing out a panel 104 in a door-like manner to access the storage space 102, expose the various interior pockets and accessory features 105, 107, and reveal any articles of clothes packed therein. As shown in FIG. 8, the garment bag 90 may be hung from a rod 103 using a hook 109 generally in accordance with known principles. Notably, the garment bag 90 alternatively may be opened and accessed while the bottom 96 and back 94 provide rigidity and support while all the wheels remain in contact with the floor or other supporting surface.

In the practice of the invention, the weight of the case 20, even when empty in a sales showroom but definitely when packed for use, overcomes the tension force of the spring 64. Accordingly, when the case 20 is placed in a first position upright with all wheels 37, 38, 46, 47 in contact with the supporting surface 23, and the arm members in the retracted position as shown in FIG. 5, the weight of the case 20 causes the wheel assemblies 40, 40' automatically to deploy to move the rear wheels 46, 47 into the extended position outboard of the back 24, and the body 22 of the case to shift to the second position shown in FIG. 6. The weight of the case 20 acts downward between the front wheels 37, 38 and the rear wheels 46, 47, which force causes the arm members 60 to pivot about the axle 70 and the front wheels and rear wheels to roll on the supporting surface 23 in substantially opposite directions until the arm member 60 attains the extended position. As the arm members 60 pivot, the body 22 shifts from the first position seen in FIG. 5 to the second, angled, position shown in FIG. 6. Advantageously, the second position of FIG. 6 provides the case 20 with a substantially longer wheel base distance between front wheels 37, 38 and rear wheels 46, 47, and the angle of body tilt, which increases the rolling stability of the case when pushed. Even more specifically, the shifting of the body 22 results from the arm member 60 and the housing 50 rotating in opposite directions about the axle 70 until the arm member reaches the extended position, such counter rotation of the arm member and the housing effectively lowering the axle 70 toward the supporting surface 23 to lengthen the wheel base and tilt the body 22.

When the case 20 is lifted from the supporting surface 23, for example to be placed in the trunk of a car or in an aircraft overhead bin, the weight of the case 20 no longer reacts upon the rear wheel 46 to maintain the arm member 60 in the extended position. With the removal of the rear wheels 46 from contact with the supporting surface 23, the spring 64 is the only significant rotary force acting on the arm member 60, with the result that the arm member 60 and wheel 46 immediately returns to the retracted position.

Accordingly, there is provided a case 20 or a garment bag 90 which presents the advantages of being compact for placement in a confined space such as the overhead storage on an airplane, and yet may be rolled upright upon four wheels across a supporting surface with stability and ease. When the case 20 is lifted from the floor or ground, the rear wheels 46, 47 are automatically retracted to a protected, non-protruding position, thus reducing the difficulty of fitting the case under a bus seat or the like, and more readily complying with airlines'carry-on luggage size limitations. Yet when it is desired to roll the case 20 across the floor or ground, simply placing the wheels 37, 38, 46, 47 of the case upon the ground and releasing the case 20 allows the weight of the case 20 automatically to swing the rear wheels into an extended position for stable rolling comfort. The extension of the wheels is accomplished with no active manipulation of the wheel assemblies by the user, and indeed virtually without the user even being consciously aware of the adapting configurations of his luggage case 20 or garment bag 90. Likewise, when the case 20 or garment bag 90 is placed in nearly any position except upright upon the floor, the rear wheels 46 and 47 automatically swing out of the way without being touched at all by the user.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of the patents cited hereinabove are hereby incorporated by reference.

We claim:

1. In an article of luggage comprising a body having a bottom, a back intersecting the bottom, at least one first wheel attached upon the bottom, and a wheel handle for rollably pushing and pulling the article across a supporting surface, an improvement including an automatically retractable and extendible wheel assembly, said assembly comprising:

at least one housing fixed on said body and having an aperture therein;

an arm member movably disposed through said aperture;

at least one other wheel rotatably mounted upon said arm member;

axle means for pivotally mounting said arm member partially within said housing for pivoting said arm member with respect to said body, said arm member pivotal between a retracted position extending from said bottom of said body and an extended position extending from said back of said body;

a stop member upon said housing contactable with said arm member when said arm member is in the extended position; and means for biasing said arm member toward the retracted position; wherein when said first wheel and said at least one other wheel are in contact with the supporting surface and said arm member is in the retracted position, said body is in a first position wherein said back is substantially vertical, and when said first wheel and said at least one other wheel are in contact with the supporting surface and said arm member is in the extended position, said body is in a second position wherein said back forms an angle from the vertical.

2. The improvement of claim 1, wherein said housing is disposed substantially at the intersection of said bottom with said back and said aperture comprises an at least partially arcuate slot, said slot common to said bottom and said back.

3. The improvement of claim 2 wherein said arm member comprises a proximate end pivotally mounted within said housing and a distal end outside said housing, and said at least one other wheel is rotatably mounted upon said distal end.

4. The improvement of claim 3 wherein said arm member is substantially planar, and further comprising two wheels rotatably mounted upon said distal end, each of said wheels mounted on an opposite side of said planar arm member.

5. The improvement of claim 4 wherein said two wheels remain outside the body when said arm member is in the retracted position and when said arm member is in the extended position.

6. The improvement of claim 1 wherein when said first wheel and said at least one other wheel are in contact with the supporting surface and said arm member is in the retracted position, the weight of the article causes said arm member to pivot about said axle means, and said first wheel and said at least one other wheel to roll on the supporting surface in substantially opposite directions until said arm member attains the extended position, whereby to shift said body from said first position to said second position.

7. The improvement of claim 6 wherein when said at least one other wheel is removed from contact with the supporting surface, said means for biasing returns said arm member to the retracted position.

8. The improvement of claim 6 wherein said angle is between approximately 14 degrees and approximately 24 degrees.

9. The improvement of claim 8 wherein said angle is approximately 19 degrees.

10. The improvement of claim 1 further comprising:

said wheel handle, extendable from said body substantially adjacent to said back, for selectively pushing and pulling said article across the supporting surface; and means for preventing said arm member from suddenly pivoting from the extended position toward the retracted position while said at least one other wheel is in contact with the supporting surface and while said case is pulled by said wheel handle.

11. The improvement of claim 10 wherein said means for preventing comprises:

a stop ledge on said arm member; and a pendulum latch hanging from a pin fixed within said housing and swingable from an equilibrium position to a locking position engaged with said stop ledge;

wherein when said arm member is in the extended position, said pendulum latch is radially aligned with said stop ledge and further wherein when the pulling of said case is abruptly stopped, said pendulum latch swings by inertia into the locking position to prevent pivotal movement of said arm member.

12. An automatically retractable and extendible wheel assembly for use in combination with a luggage case to roll said case across a supporting surface, said luggage case comprising a body in which clothing and personal items may be stored, said body having a bottom, a first wheel upon said bottom, and a back intersecting said bottom to extend upwardly therefrom, said wheel assembly comprising:

at least one hollow housing fixed on said body substantially at the intersection of said bottom with said back;

an arm member having a proximate end and a distal end;

axle means for pivotally mounting said proximate end of said arm member within said housing for rotation of said arm member and said housing with respect to each other, said arm member pivotal between a retracted position and an extended position with respect to said back;

a stop member upon said housing contactable with said arm member when said arm member is in the extended position;

means for biasing said arm member toward the retracted position; and at least one other wheel rotatable upon said distal end of said arm member;

wherein when said arm member is in the retracted position and said case is placed upon the supporting surface with said first wheel and said other wheel in contact with the supporting surface, the weight of the case causes said arm member and said housing to rotate in opposite directions about said axle means, and said first wheel and said other wheel to roll on the supporting surface in substantially opposite directions until said arm member attains the extended position, whereby to lower said axle means toward the supporting surface to shift said body from a first position to a second position with respect to the supporting surface, and further wherein when said case is lifted from the supporting surface said means for biasing returns said arm member to the retracted position.

13. An assembly according to claim 12 wherein said housing has an at least partially arcuate slot aperture defined in said housing and common to said bottom and said back, and said arm member is movably disposed through said aperture and said distal end of said arm member remains outside said housing.

14. An assembly according to claim 12 wherein said arm member extends from said bottom when in the retracted position, and said arm member extends from the back when in the extended position.

15. An assembly according to claim 14 wherein when said body is in the first position said back is substantially vertical with respect to the supporting surface, and wherein when said body is in the second position said back is at an angle with respect to vertical.

16. An assembly according to claim 15, wherein said angle is between approximately 14 degrees and approximately 24 degrees.

17. An assembly according to claim 16, wherein said angle is approximately 19 degrees.

18. An assembly according to claim 15 further comprising:

a wheel handle, extendable from said body substantially adjacent to said back, for selectively pushing and pulling said case across the supporting surface; and means for preventing said arm member from suddenly pivoting from the extended position toward the retracted position while said other wheel is in contact with the supporting surface and when the pulling of said case is abruptly stopped.

19. An assembly according to claim 18 wherein said means for preventing comprises:

a stop ledge on said arm member; and a pendulum latch hanging from a pin fixed within said housing and swingable from an equilibrium position to a locking position engaged with said stop ledge;

wherein when said arm member is in the extended position, said pendulum latch is radially aligned with said stop ledge and further wherein when the pulling of said case is abruptly stopped, said pendulum latch swings by inertia into the locking position to prevent pivotal movement of said arm member.

20. An automatically retractable and extendible wheel assembly for use in combination with a luggage case to roll said case across a supporting surface, said luggage case comprising a body having a bottom, two front wheels upon said bottom, and a back intersecting said bottom to extend upwardly therefrom, said wheel assembly comprising:

at least one hollow housing fixed on said body substantially at the intersection of said bottom with said back and having a slot aperture therein;

a substantially planar arm member movably disposed through said aperture and having a proximate end and a distal end and;

axle means for pivotally mounting said proximate end of said arm member within said housing, whereby said arm member and said housing are rotatable with respect to each other, said arm member pivotal between a retracted position and an to extended position with respect to said back;

a stop member upon said housing contactable with said arm member when said arm member is in the extended position;

means for biasing said arm member toward the retracted position; and two rear wheels rotatably mounted upon opposite sides of said distal end of said arm member;

wherein when said arm member is in the retracted position and said case is placed upon the supporting surface with said front wheel and said two rear wheels in contact with the supporting surface, the weight of the case causes said arm member and said housing to rotate in opposite directions about said axle means, and said front wheel and said rear wheels to roll on the supporting surface in substantially opposite directions until said arm member attains the extended position, whereby to lower said axle means toward the supporting surface to shift said body from a first position to a second position with respect to the supporting surface, and further wherein when said case is lifted from the supporting surface said arm member returns to the retracted position.

21. The asssembly of claim 20 wherein said aperture comprises an at least partially arcuate slot common to said bottom and said back.

22. The assembly of claim 21 wherein said distal end of said arm member remains outside said housing when said arm member is in the retracted position and when said arm member is in the extended position.

23. The assembly of claim 22 wherein when said front wheels and said two rear wheels are in contact with the supporting surface and said arm member is in the retracted position, the weight of the luggage case causes said arm member to pivot about said axle means, and said front wheels and said two rear wheels to roll on the supporting surface in substantially opposite directions until said arm member attains the extended position, whereby to shift said body from said first position to said second position.

24. The assembly of claim 23 wherein when said two rear wheels are removed from contact with the supporting surface, said means for biasing returns said arm member to the retracted position.

25. The assembly of claim 20 wherein when said body is in the second postion, said body forms an angle, with respect to the vertical, of between approximately 14 degrees and approximately 24 degrees.

26. The improvement of claim 25 further comprising:

a wheel handle, extendable from said body substantially adjacent to said back, for selectively pushing and pulling said article across the supporting surface; and means for preventing said arm member from suddenly pivoting from the extended position toward the retracted position while said two rear wheels are in contact with the supporting surface and while said case is pulled in the second postion by said wheel handle.

27. The assembly of claim 26 wherein said means for preventing comprises:

a stop ledge on said arm member; and a pendulum latch hanging from a pin fixed within said housing and swingable from an equilibrium position to a locking position engaged with said stop ledge;

wherein when said arm member is in the extended position, said pendulum latch is radially aligned with said stop ledge and further wherein when the pulling of said case is abruptly stopped, said pendulum latch swings by inertia into the locking position to prevent pivotal movement of said arm member.

28. The assembly of claim 20 wherein when said body is in the second postion, said body forms an angle, with respect to the vertical, of approximately 19 degrees.

* * * * *